US006748629B2

(12) United States Patent
Gould

(10) Patent No.: US 6,748,629 B2
(45) Date of Patent: Jun. 15, 2004

(54) RETAINING ARRANGEMENT FOR KEY HOLDERS

(76) Inventor: Richard Gould, 16 Datchett Street, Balmain, New South Wales 2041 (AU)

( * ) Notice: Subject to any disclaimer, the term of this patent is extended or adjusted under 35 U.S.C. 154(b) by 0 days.

(21) Appl. No.: 10/258,821

(22) PCT Filed: Apr. 24, 2001

(86) PCT No.: PCT/AU01/00466

§ 371 (c)(1),
(2), (4) Date: Jan. 31, 2003

(87) PCT Pub. No.: WO01/80696

PCT Pub. Date: Nov. 1, 2001

(65) Prior Publication Data

US 2003/0154573 A1 Aug. 21, 2003

(30) Foreign Application Priority Data

Apr. 26, 2000 (AU) ..... PQ 7092
Dec. 12, 2000 (AU) ..... PR 2020

(51) Int. Cl.[7] ..... A44B 13/00; A47G 29/10

(52) U.S. Cl. ..... 24/3.6; 24/3.1; 24/3.11; 70/456 R; 70/458

(58) Field of Search ..... 24/3.6, 3.1, 3.11; 70/456 B, 456 R, 457, 458, 459, 389; 81/485; 235/375

(56) References Cited

U.S. PATENT DOCUMENTS 867,255 A * 10/1907 Dietz ..... 24/3.6
2,250,328 A * 7/1941 Daniels ..... 24/3.6
2,964,937 A * 12/1960 Lautin ..... 70/456 R
2,978,897 A * 4/1961 Capitani ..... 70/456 R
3,716,091 A * 2/1973 Gaines ..... 70/456 R
3,823,587 A * 7/1974 Tcherdakoff ..... 70/456 R
3,929,266 A * 12/1975 Kim ..... 24/3.6
4,004,325 A * 1/1977 Hubachek ..... 24/3.6
4,062,212 A 12/1977 Klein
4,317,638 A * 3/1982 Klaber ..... 70/458
4,516,418 A * 5/1985 Cuttler ..... 70/456 R
4,656,853 A * 4/1987 Mancini ..... 70/456 R
5,778,495 A * 7/1998 Paugh ..... 24/3.6
6,237,756 B1 * 5/2001 Caudle ..... 70/456 R

FOREIGN PATENT DOCUMENTS

EP 149102 A2 7/1985
JP 09-028548 A 2/1997
JP 09-268811 A 10/1997

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

A retaining arrangement retains a key holder of a type having a tag suspended from a ring with the ring also holding at least one key. The retaining arrangement includes a panel. A plurality of slots is defined by the panel. Each slot is shaped and dimensioned to receive the tag of the key holder through it such that the key of the key holder lies on one side of the panel and the tag lies on an opposed, operatively outer side of the panel.

18 Claims, 12 Drawing Sheets

RETAINING ARRANGEMENT FOR KEY HOLDERS

CROSS REFERENCE TO RELATED APPLICATIONS

This application is a national phase application based on PCT/AU01/00466, filed Apr. 24, 2001, the content of which is incorporated herein by reference, and claims the priority of Australian Patent Application Nos. PQ7092, filed Apr. 26, 2000, and PR 2020, filed Dec. 12, 2000, the content of both of which is incorporated herein by reference.

FIELD OF THE INVENTION

This invention relates to a retaining arrangement. More particularly, the invention relates to a retaining arrangement for retaining at least one key holder. The key holder is of a type comprising a tag suspended from a ring. The ring also holds at least one key and often includes additional items such as remote control devices.

BACKGROUND TO THE INVENTION

Where a large number of keys are stored at a central location it is important to be able to ascertain readily when such keys are absent. Examples of places where a large number of key holders are located include motor vehicle service stations, motor vehicle sales lots, a caretaker's office in a building, a real estate office, or the like.

Further, it is often necessary to be able to make those keys available to personnel for various purposes and, in such circumstances, a person in authority must be able to determine if any keys have been removed from the central location.

To date, as far as the applicant is aware, keys have been stored on boards by being suspended from hooks. Such storage arrangements are not secure and any unauthorised personnel can easily remove key holders from such storage arrangements.

These storage arrangements may, if desired, be contained within a cabinet. However, once the cabinet has been opened, unauthorised access can again be gained to the key holders on the storage arrangement.

In addition, the key holders are not securely held on such a storage arrangement and they often fall off.

Still further, when there are a large number of key holders on such a storage arrangement it is difficult to tell if any key holders have been removed, particularly where the key holders contain large bunches of keys.

SUMMARY OF THE INVENTION

According to the invention, there is provided a retaining arrangement for retaining a key holder of a type comprising a tag suspended from a ring with the ring also holding at least one key, the retaining arrangement including:

a surface defining element; and at least one retaining means defined by the surface defining element, the at least one retaining means being shaped and dimensioned to receive the tag of the key holder through it such that the at least one key of the key holder lies on one side of the surface defining element and the tag lies on an opposed, operatively outer side of the surface defining element.

Preferably, the surface defining element is a planar element in the form of a panel.

The at least one retaining means may be in the form of a substantially T-shaped slot defined in the panel, the slot being shaped and dimensioned to hold the key on said one side of the panel, the ring being at least partially received within the slot and the tag being arranged on the opposed side of the panel.

The slot may be substantially cruciform in shape having a longitudinal part and a transverse part which intersects the longitudinal part. The transverse part of the slot may intersect the longitudinal part inwardly of one end of the longitudinal part so that said one end of the longitudinal part extends beyond the transverse part. If desired, the transverse part may have a stepped or castellated appearance for facilitating insertion of the tag through the slot. The longitudinal part of the slot may have a length which allows it to accommodate the ring of more than one key holder.

Preferably, a plurality of slots is defined in the surface defining element so that the surface defining element can hold a number of key holders.

The surface defining element may include a mounting formation for mounting it to a support structure. The mounting formation may be a hinge for hingedly attaching the surface defining element to the support structure. The arrangement may include a locking means carried on the surface defining element for locking the surface defining element in position relative to the support structure. Accordingly, it will be appreciated that the surface defining element may be pivotally arranged, via its hinge, relative to the support structure to pivot between a first, locked position and a second, unlocked position.

The support structure may include a backing member which is arranged adjacent the one side of the surface defining element so that, when the surface defining element is in its locked position relative to the support structure, the backing member inhibits unauthorised removal of the key holder from its associated slot of the surface defining element.

More particularly, the backing member may be a second surface defining element hingedly carried by the support structure, the surface defining elements being spaced from each other by a gap so that, when both surface defining elements are in their locked position, the gap has a width dimension, as measured between the one side of the surface defining element and an operatively outer side of the second surface defining element, which is less than a length of a shortest key carried by a key holder of either surface defining element for inhibiting unauthorised withdrawal of the key holder from its associated surface defining element. In addition, where the key holder holds thin keys, ie, keys not much thicker than the tag, an excluder element may be mounted on the ring of the key holder. The excluder element may be a block of synthetic plastics material which is significantly larger than the transverse part of the slot to inhibit withdrawal of the excluder element through the transverse part of the slot.

The gap may be defined by complementary lips extending at right angles from the surface defining elements, the lips abutting or overlying one another when both surface defining elements are in their locked position relative to the support structure.

Instead of the backing member being another surface defining element, the backing member may, for example, be a back wall of the support structure or may be a sheet of an elastomeric material which lies in close proximity to, or bear against, the surface defining element when the surface defining element is in its locked position.

Preferably, the support structure is a cabinet with the, or each, surface defining element being hingedly mounted in a chamber defined by the cabinet.

The chamber may be closed off by a closure element, the closure element including a locking device for locking it in position relative to the cabinet. The closure element may be the surface defining element. In that event, the locking device of the closure element may be the locking means of the surface defining element.

The closure element and a closure element surround of the cabinet may have anti-jemmying features for inhibiting unauthorised access being gained to the chamber of the cabinet.

The anti-jemmying features of the surround and of the closure element may comprise complementary re-entrant lips. Should an attempt be made to jemmy such lips, it causes the lip of the closure element to engage the lip of the surround to lock the closure element in position relative to the surround. In addition, the lip of the closure element may be interrupted by slots, to effectively form a plurality of tabs so that each tab is individually movable with respect to its adjacent tabs in the event that that tab is jemmied.

The cabinet may be portable, the arrangement including a mounting means for mounting the cabinet to a backing structure. The mounting means may include a securing means for lockably securing the cabinet to the backing structure.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
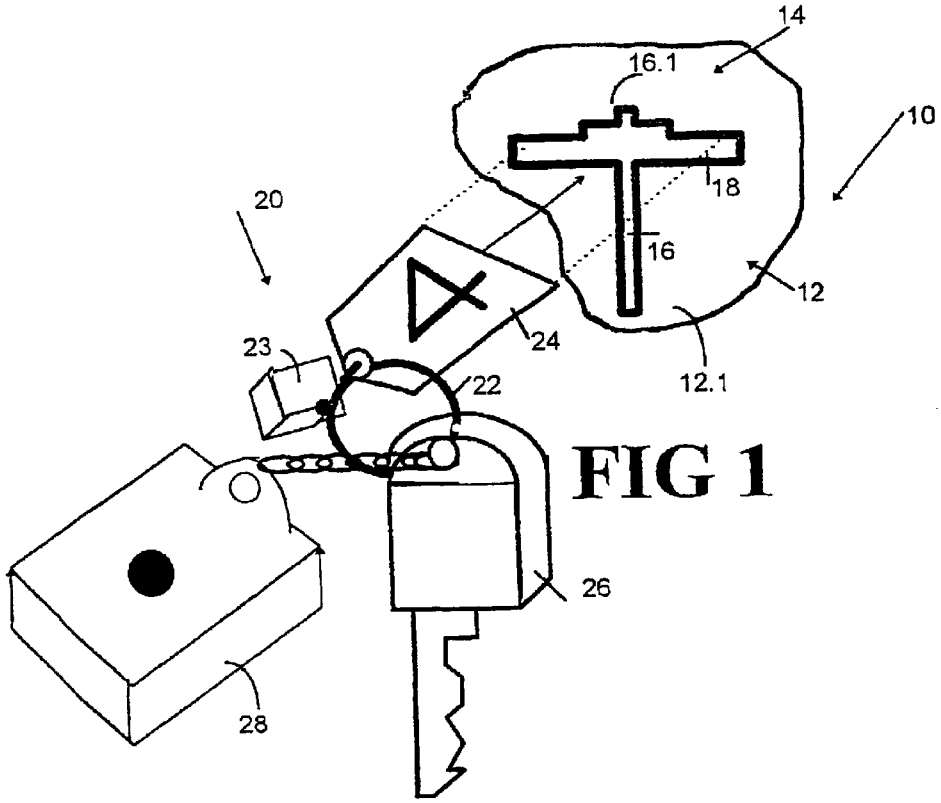
FIG. 1 shows a schematic representation of a retaining arrangement, in accordance with the invention, for retaining a key holder.
Figure 2:
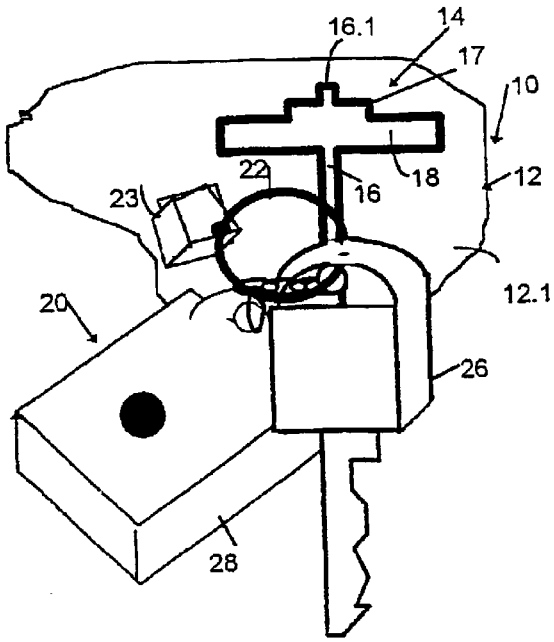
FIG. 2 shows a schematic representation of the retaining arrangement of FIG. 1, in use.
Figure 3:
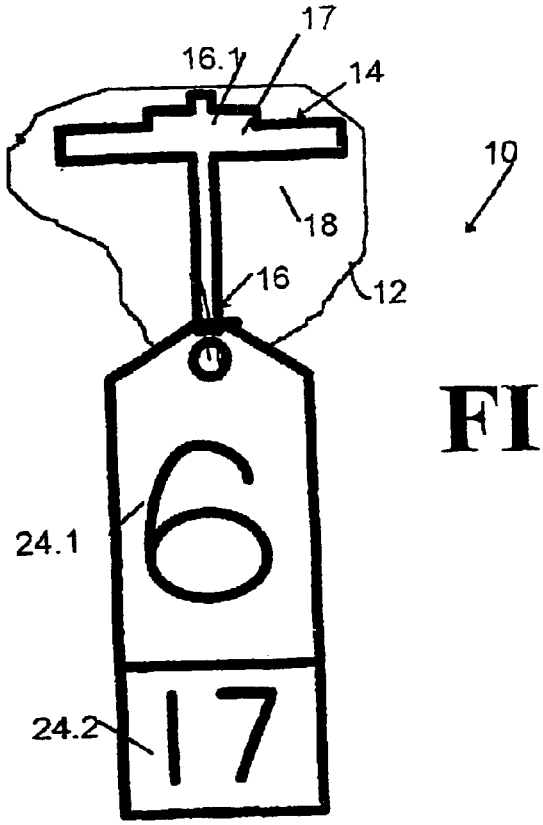
FIG. 3 shows a schematic representation of the retaining arrangement retaining a plurality of key holders.

In the drawings, reference numeral 10 generally designate a retaining arrangement, in accordance with the invention, for retaining a key holder. The retaining arrangement 10, preferably, is used for retaining a number of key holders 20. The retaining arrangement 10 comprises a surface defining element in the form of a panel 12. The panel 12 has a plurality of retaining means defined therein. Each retaining means is in the form of a cruciform-shaped slot 14. Each slot 14 has a longitudinal part 16 and a transverse part 18. The transverse part 18 intersects the longitudinal part 16 below an end 16.1 of the longitudinal part to impart the cruciform shape to the slot 14. As indicated at 17 in FIG. 2 of the drawings, the transverse part 16 of the slot 14 is castellated or stepped to facilitate insertion of a tag 24 of the key holder 20 into the slot 14.

The retaining arrangement 10 is intended particularly for use with key holders 20 of the type having a ring 22 carrying a tag 24. One or more keys 26 and other devices such as a remote control device 28 are also arranged on the ring 22. In addition where thin keys are carried on the key holder 20, an excluder block 23 is also attached to the ring 22. By "thin key" is meant a key having a thickness approximately the same as the tag 24 and the width of the transverse part 18 of the slot 14. In contrast, the excluder block 23 has length, width and height dimensions which are much greater than the width of the transverse part 18 of the slot 14 to inhibit withdrawal of the thin key through the transverse part 18 of the slot 14.

Figure 4:
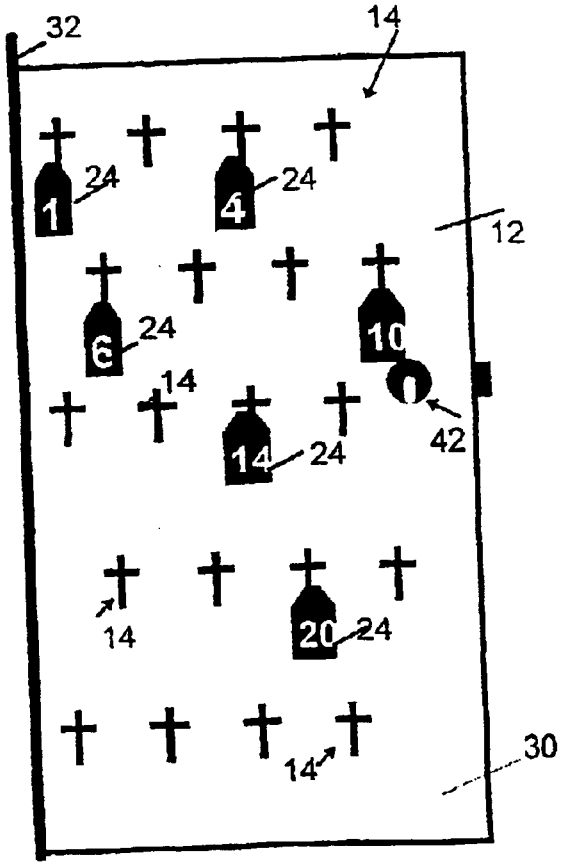
FIG. 4 shows a front view of the retaining arrangement.

The length of the transverse part 18 of the slot corresponds to a width of the tag 24 of the key holder 20 so that, when the tag 24 of the key holder 20 is inserted through the transverse part 18 of the slot 14, the ring 22 is received in the longitudinal part 16 of the slot 14. In this position, the key 26 and the remote control device 28 of the key holder 20 are retained on one side 12.1 of the panel 12 with the tag 24 lying on an opposed, operatively outer side 30 (FIG. 4) of the panel 12.

Figure 5:
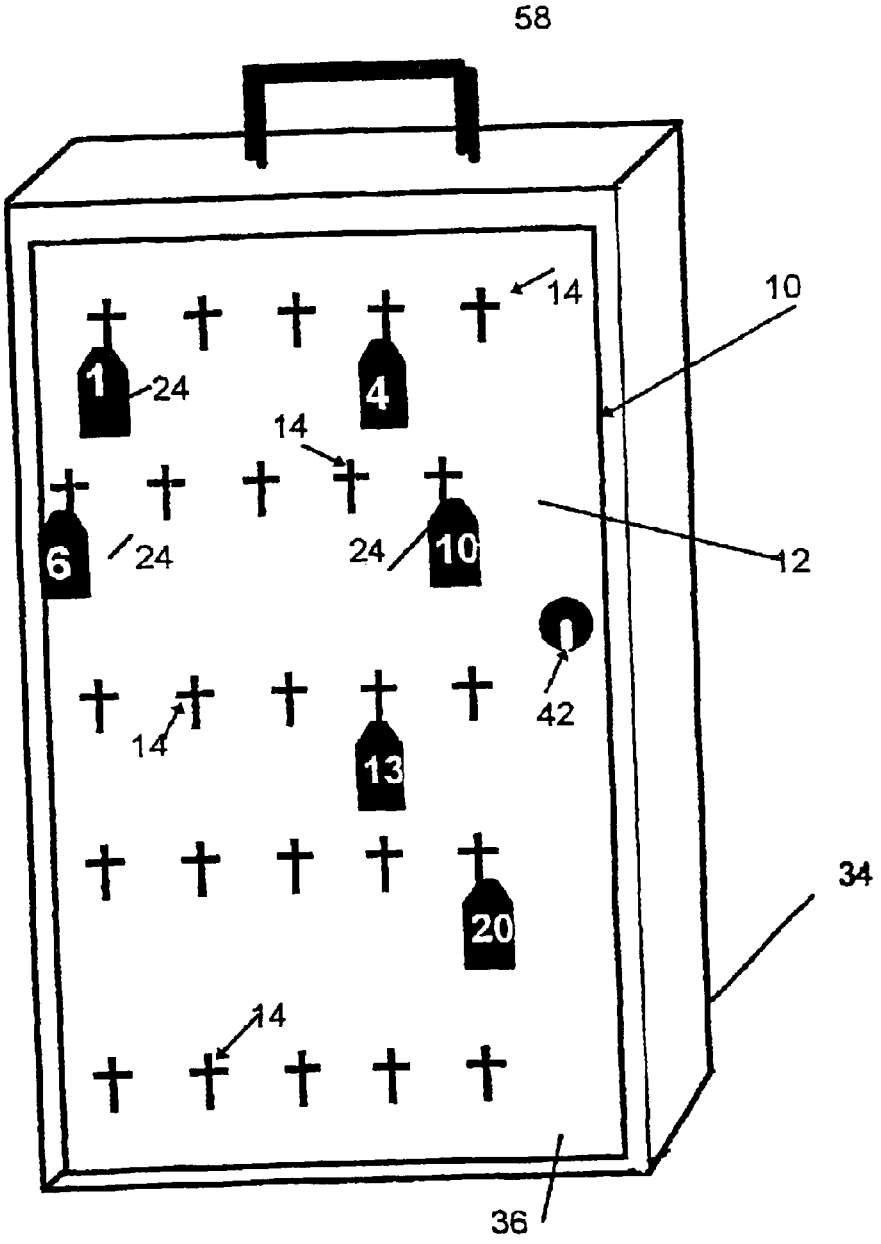
FIG. 5 shows a three-dimensional view of the retaining arrangement mounted in a support structure.
Figure 9:
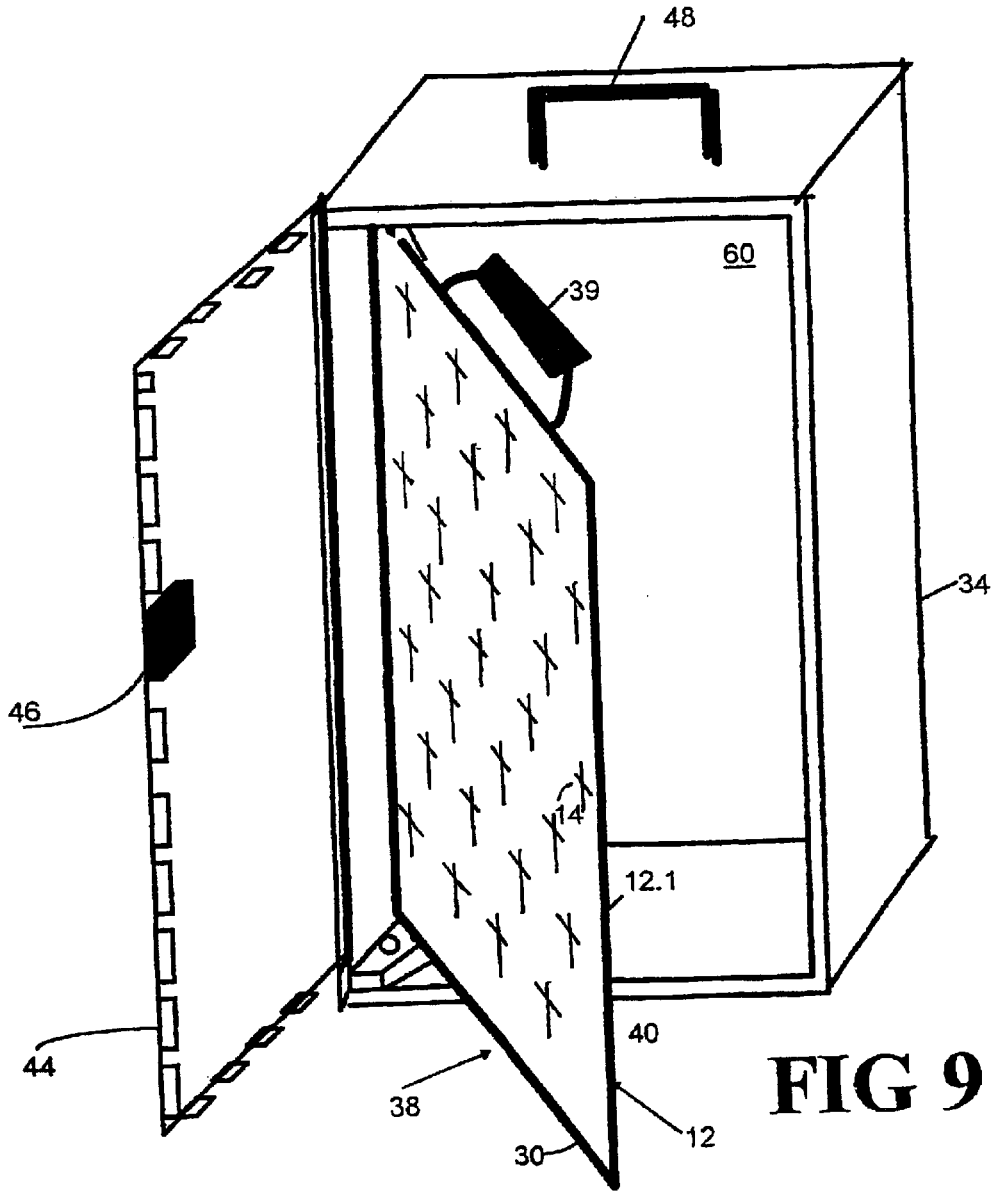
FIG. 9 shows a three-dimensional, schematic view of an embodiment of a retaining arrangement assembly.
Figure 10:
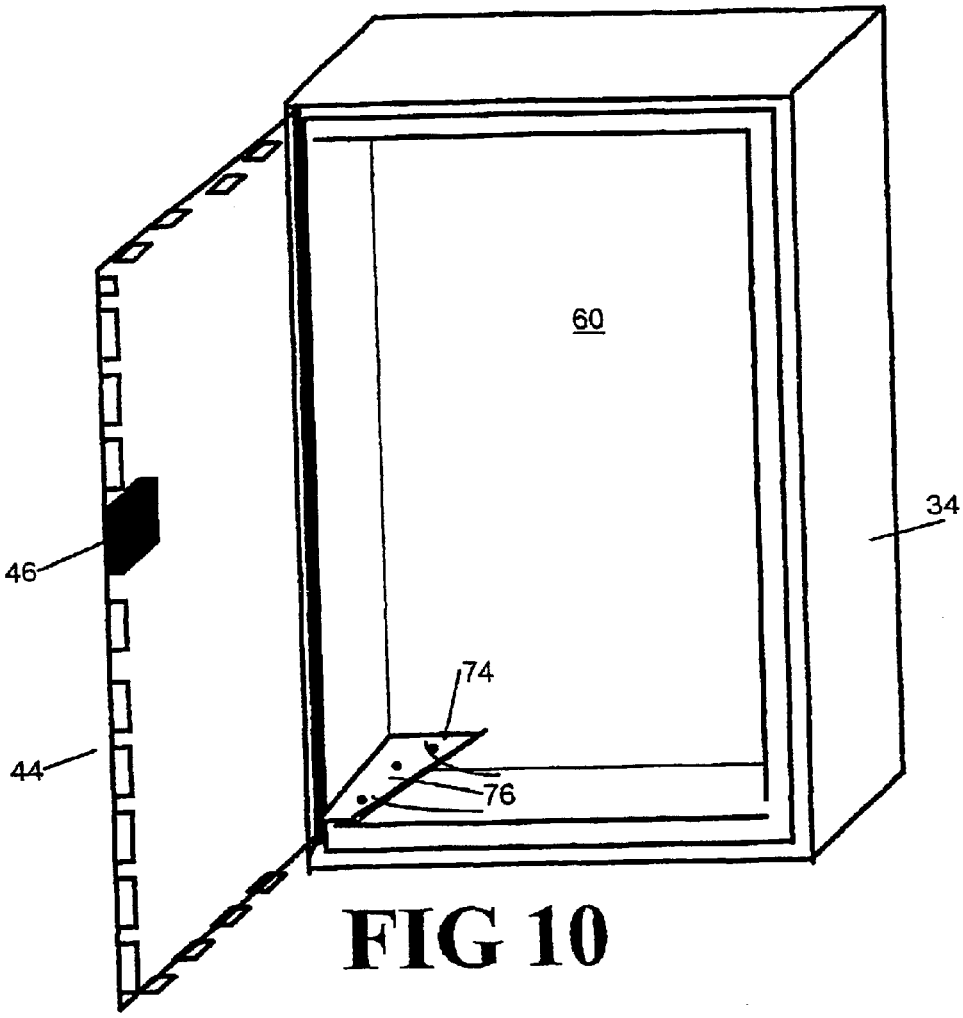
FIG. 10 shows a three-dimensional view of the support structure of the retaining arrangement assembly of FIG. 9.
Figure 11:
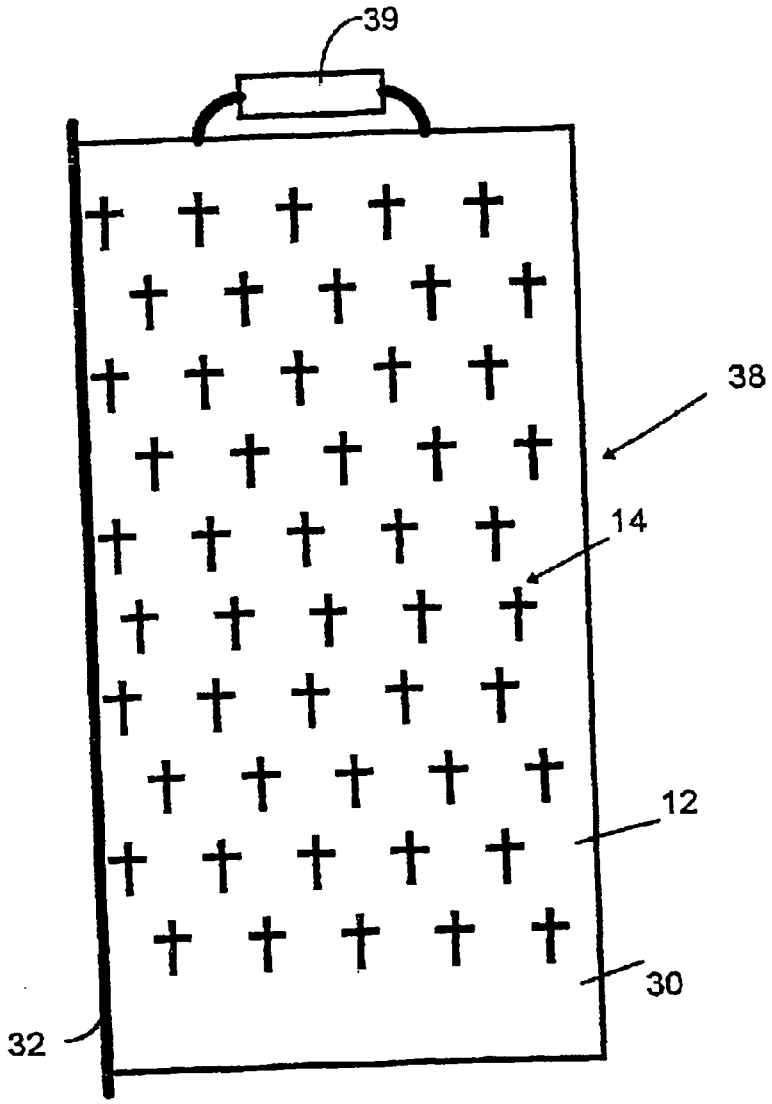
FIG. 11 shows a front view of the retaining arrangement of the assembly of FIG. 9.
Figure 15:
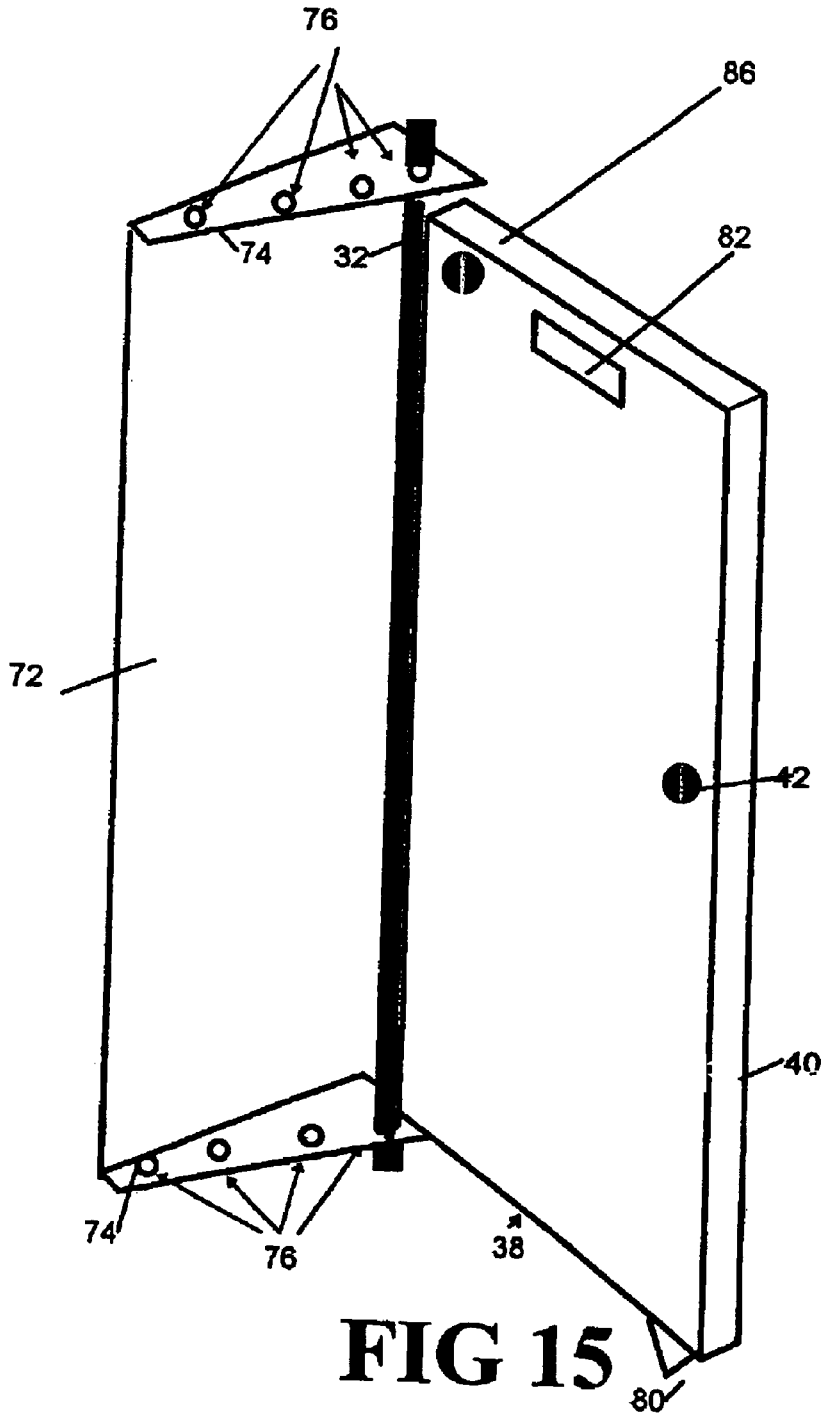
FIG. 15 shows a three-dimensional view of how the part of the retaining arrangement of FIG. 12 is mounted in a support structure.
Figure 16:
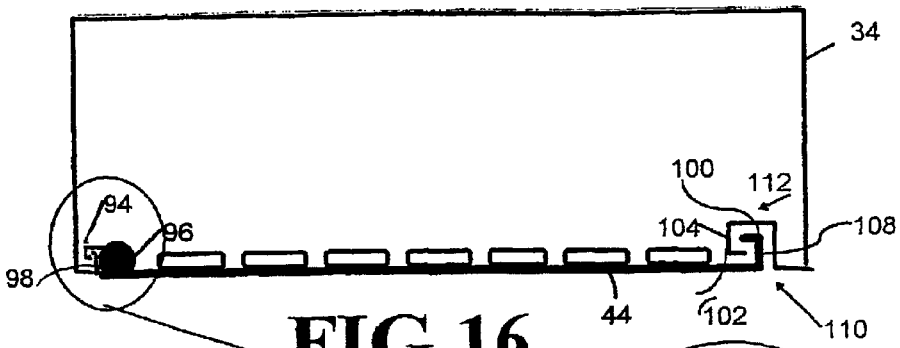
FIG. 16 shows a schematic, sectional plan view of the retaining arrangement assembly including anti-jemmying features thereof.
Figure 17:
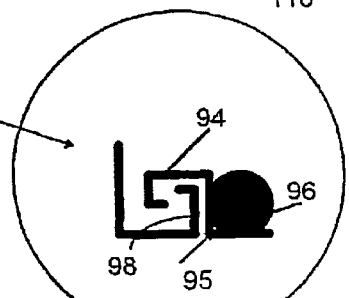
FIG. 17 shows, on an enlarged scale, the anti-jemmying features of part of the retaining arrangement assembly.
Figure 18:
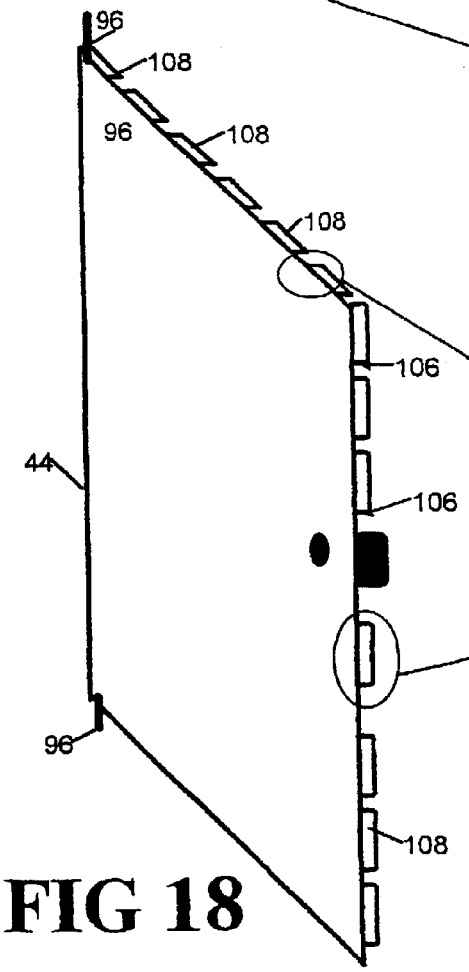
FIG. 18 shows a three-dimensional view of a closure element of the support structure showing its anti-jemmying features.

The panel 12 includes a mounting formation in the form of a hinge 32 for mounting it to a support structure such as a cabinet 34 (FIG. 5). The panel 12 can either form a door 36 (FIG. 5) of the cabinet 34 or the panel 12 can be received as an insert 38 as shown in FIG. 9 of the drawings. In the latter case, the hinge 32 is a "drop-in" type of hinge to allow the insert 38 to be removed from the cabinet 34 to be carried. A handle 39 is arranged on the insert 38 for this purpose. Further, for this purpose, the interior of the cabinet 34 has a frame 72 (FIG. 15). The frame 72 includes a pair of horizontally extending flanges 74. The flanges 74 have corresponding, aligned holes 76 defined therethrough.

Where the panel 12 is used as a door of the cabinet 34, the panel 12 includes a lock 42 for locking it in a locked position relative to the cabinet 34. Only predetermined personnel may have keys which fit the lock 42. When the panel 12 is in the form of the insert 38 in the cabinet 34, as shown in FIG. 9 of the drawings, the cabinet 34 includes a separate door 44 having two locks, one being shown at 46. Only one or two authorised persons may have keys for the lock 46. The other lock may, for example, be an electronic combination lock to which additional personnel have the combination code.

Figure 7:
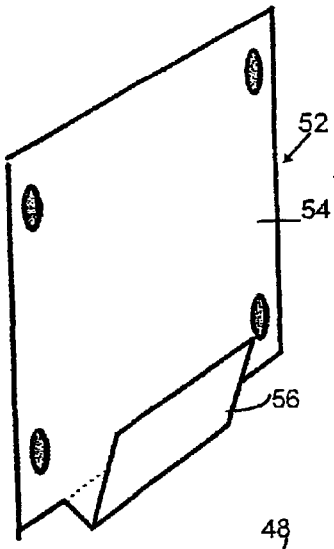
FIG. 7 shows, on an enlarged scale, part of a mounting means associated with the support structure.
Figure 6:
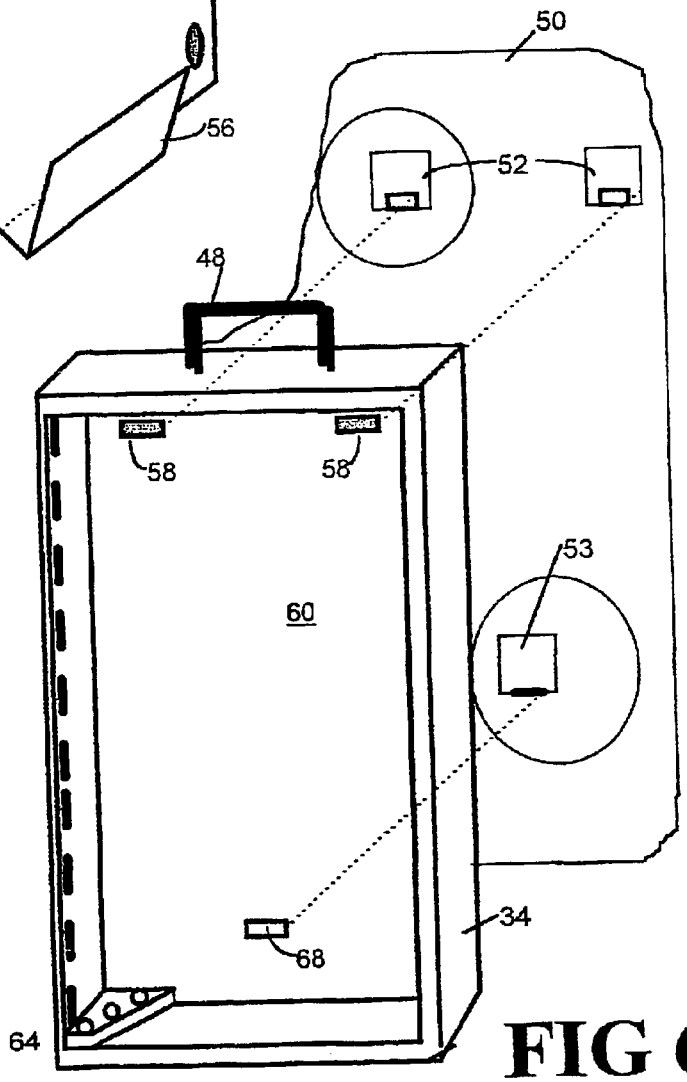
FIG. 6 shows a schematic, three-dimensional representation of the support structure.

The cabinet 34 is a portable device and includes a handle 48. In addition, to mount the cabinet 34 on a backing structure such as a wall 50 (FIG. 6) the retaining arrangement includes a mounting means in the form of a plurality of mounting brackets 52, 53. One of two mounting brackets 52 is shown on an enlarged scale in FIG. 7 of the drawings. Each bracket 52 includes a backing plate 54 which is secured to the wall 50. An upwardly turned tab 56 extends from a bottom edge of the backing plate 54. The tab 56 is received in an associated slot 58 in a rear wall 60 of the cabinet 34.

Figure 8:
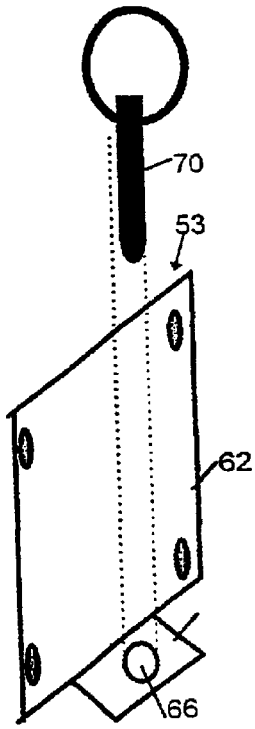
FIG. 8 shows, on an enlarged scale, a further part of the mounting means.

A single mounting bracket 53 is provided and is shown on an enlarged scale in FIG. 8 of the drawings. The bracket 53 also includes a backing plate 62 securable to the wall 50. A tab 64 projects at substantially right angles from a bottom edge of the backing plate 62. The tab 64 has a hole 66 defined in it. The tab 64 of the bracket 53 is received in a slot 68 in the rear wall 60 of the cabinet 34 and a securing means in the form of a securing pin 70 is removably received through the hole 66 in the tab 64 for retaining the cabinet 34 in position on the wall 50.

Figure 12:
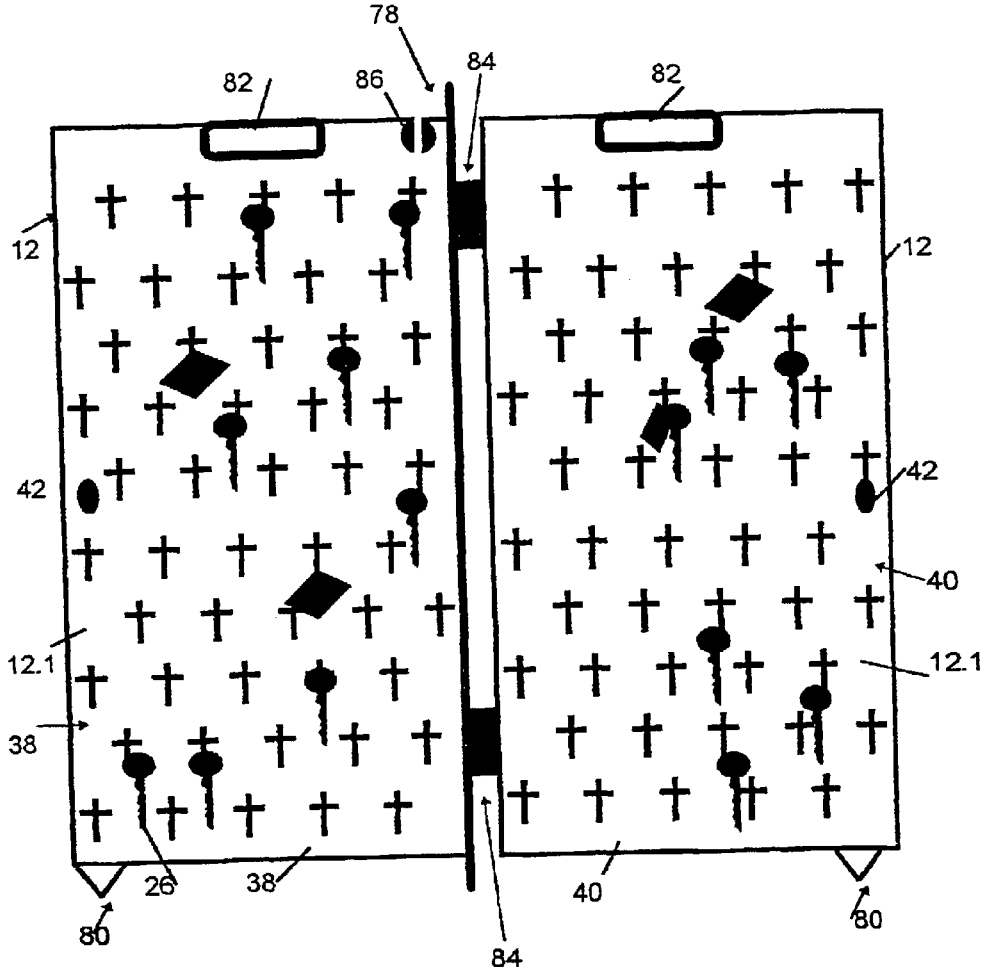
FIG. 12 shows a front view of part of another embodiment of the retaining arrangement.
Figure 13:
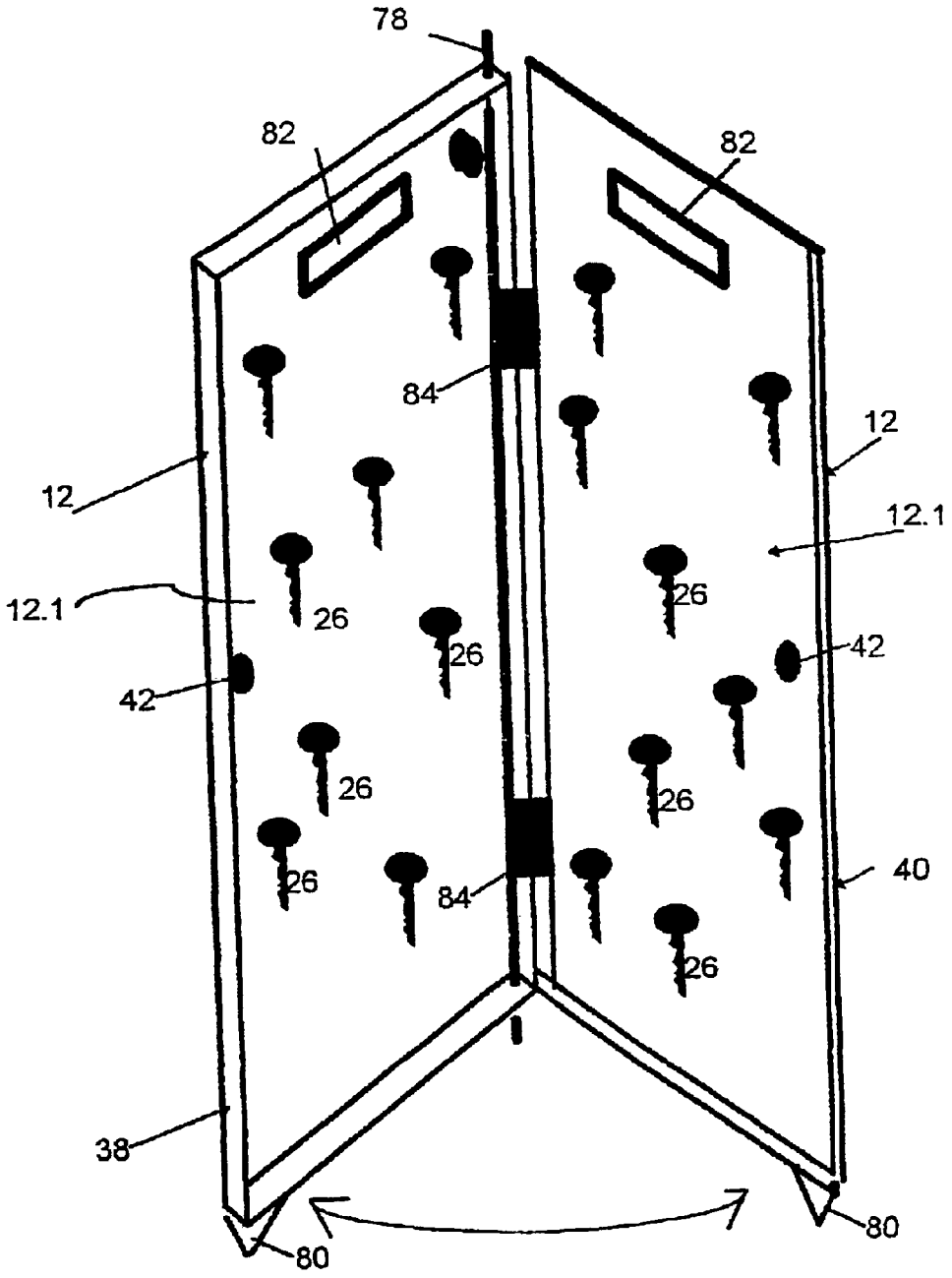
FIG. 13 shows a three-dimensional, schematic view of the part of the retaining arrangement of FIG. 12.

Referring now to FIG. 12 of the drawings, another embodiment of the invention is illustrated. With reference to the previous drawings, like reference numerals refer to like parts, unless otherwise specified.

Two panels 12 of the retaining arrangement are provided as inserts 38, 40 in the interior of the cabinet 34. For this purpose, the interior of the cabinet 34 has the frame 72.

The insert 38 has a mounting hinge 78. The hinge 78 of the insert 38 is received in vertically aligned holes 76 of the flanges 74 for pivotally mounting the inserts 38, 40 relative to the cabinet 34. It is to be noted that the insert 38 carries the hinge 78 and the insert 40 is hinged to the insert 38 via hinges 84.

For assisting in pivoting of the inserts 38, 40 relative to each other and relative to the cabinet 34, the inserts 38, 40 have feet 80. In addition, to enable the inserts 38, 40 to be carried, handles 82 are defined in the inserts 38, 40.

The insert 38 includes a lock 86 for locking the inserts 38, 40 to the frame 72.

Figure 14:
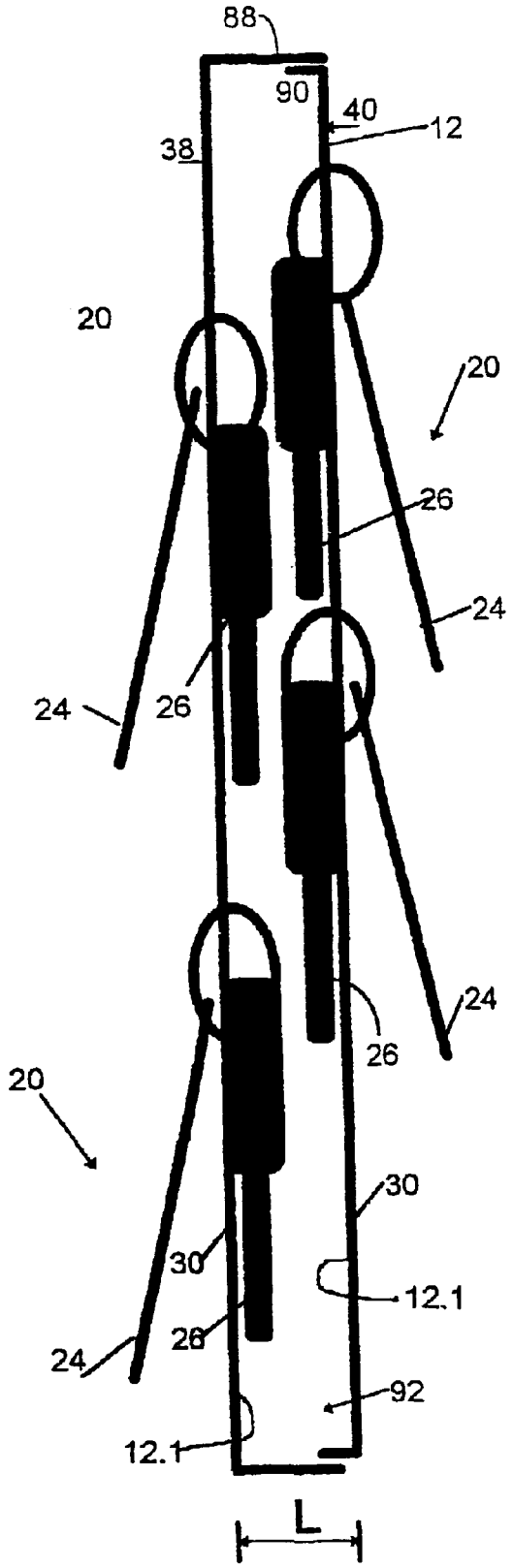
FIG. 14 shows a schematic, sectional side view of the part of the retaining arrangement of FIGS. 12 and 13.

The insert 38 includes, on its operatively inner side 12.1 a surrounding lip or skirt 88. This skirt 88 overlies a similar, but shorter, skirt 90 of the insert 40 and defines a gap 92 between the inserts 38 and 40 when the inserts 38 and 40 are locked together. A length L (FIG. 14) of the gap 92 is significantly less than a length of a shortest key 26 of the key holder 20 so that, should an attempt be made to withdraw the key holder 20 from the slot 14, for example, from the insert 38, a free end of the key 26 will abut against an interior surface 12.1 of the insert 40 thereby inhibiting withdrawal of the key through the transverse part 18 of the slot 14. It will be appreciated that a similar situation applies in respect of any key holder 20 on the insert 40.

Further, instead of this safety feature being applicable only with respect to the two inserts 38 and 40, when locked together, a similar arrangement could apply with respect to a single panel 12. When the single panel 12 is in its locked position in the cabinet 34, a gap between the panel 12 and, for example, a rear wall of the cabinet 34 is such that it is much less than the length of the shortest key of the key holder 20 to inhibit withdrawal of the key holder 20 from its slot 14. Another embodiment may make use of an elastomeric packing sheet (not shown) against which keys 26 of the key holders 20 bear when the panel 12 is in its locked position in the cabinet 34 to inhibit withdrawal of the keys 26 through the transverse parts 18 of their associated slots 14.

The cabinet 34 makes use of anti-jemmying features on the door 44 and on the part of the cabinet 34 surrounding the door 44. The anti-jemmying features, firstly, include a reentrant flange 94 arranged adjacent a hinge 96 of the door 44 and a corresponding re-entrant flange 98 arranged on the cabinet. Should the hinge 96 be removed while the door 44 is in its closed position and an attempt made to force the door 44, for example, by inserting a screw driver into a gap 95, the flange 98 engages the flange 94 thereby inhibiting removal of the door 44 from the cabinet 34.

Figure 19:
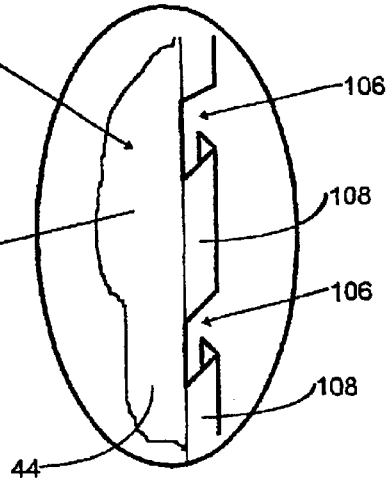
FIG. 19 shows, on an enlarged scale, the anti-jemmying features of the closure element.

A further anti-jemmying feature of the cabinet 34 is the use of a re-entrantly folded lip or edge 100 on the remaining edges of the door 44. This edge 100 is aligned with a similarly re-entrant lip or edge 102 in a recessed region 104 of the cabinet 34. Further, as illustrated more clearly in FIG. 19 of the drawings, the edge 100 of the door 44 is interrupted by slots 106 to define a plurality of discrete tabs 108. Should an attempt be made to force the door 44 by inserting a screw driver or other device in a gap 110 between the edge of the door 44 and the cabinet, by bending the tab 108 in the direction of arrow 112 the edge 100 engages the edge 102 serving to lock the door to the cabinet 34. Also, due to the fact that the edge 100 of the door 44 is comprised of discrete tabs 108 it is only that tab which bends. This makes it very difficult for somebody to force the door 44 as only the individual tabs 108 will be bent rather than the entire edge 100 of the door.

It is an advantage of the invention that a retaining arrangement 10 is provided which enables key holders 20 to be stored in an arrangement in which they are clearly visible. In so doing, a person can, at a glance, tell when a particular key holder 20 has been removed from the retaining arrangement 10. Also, the arrangement of the slots 14 and tags 24 facilitates the rapid mounting of the key holders 20 on the retaining arrangement 10 and in such-a way that the key holders 10 are clearly identifiable. Large numbers of key holders 20 can be stored while still enabling their tags 24 to be readily visible.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A retaining arrangement for retaining a key holder of a type comprising a tag suspended from a ring with the ring also holding at least one key, the retaining arrangement including:

a surface defining element; and at least one retaining means defined by the surface defining element, the at least one retaining means being in the form of a substantially T-shaped slot defined in the surface defining element to receive the tag of the key holder through it such that the key of the key holder lies on one side of the surface defining element and the tag lies on an opposed, operatively outer side of the surface defining element and the ring being received at least partially within the slot.

2. The arrangement of claim 1 in which the surface defining element is in the form of a panel.

3. The arrangement of claim 1 in which the slot is substantially cruciform in shape having a longitudinal part and a transverse part which intersects the longitudinal part.

4. The arrangement of claim 3 which the transverse part of the slot intersects the longitudinal part inwardly of one end of the longitudinal part so that said one end of the longitudinal part extends beyond the transverse part.

5. The arrangement of claim 3 in which the longitudinal part of the slot has a length which allows it to accommodate the ring of more than one key holder.

6. The arrangement of claim 1 in which a plurality of slots is defined in the surface defining element so that the surface defining element can hold a number of key holders.

7. The arrangement of claim 1 in which the surface defining element includes a mounting formation for mounting it to a support structure.

8. The arrangement of claim 7 in which the mounting formation is a hinge for hingedly attaching the surface defining element to the support structure.

9. The arrangement of claim 7 which includes a locking means carried on the surface defining element for locking the surface defining element in position relative to the support structure.

10. The arrangement of claim 9 in which the support structure includes a backing member which is arranged adjacent said one side of the surface defining element so that, when the surface defining element is in its locked position relative to the support structure, the backing member inhibits unauthorised removal of the key holder from the surface defining element.

11. The arrangement of claim 10 in which the backing member is a second surface defining element hingedly carried by the support structure, the surface defining elements being spaced from each other by a gap so that, when both surface defining elements are in their locked position, the gap has a width dimension, as measured between said one side of the surface defining element and an operatively outer side of the second surface defining element, which is less than a length of a shortest key carried by a key holder of either surface defining element for inhibiting unauthorised withdrawal of said key holder from its associated surface defining element.

12. The arrangement of claim 9 in which the support structure comprises a cabinet with the surface defining element being hingedly mounted in a chamber defined by the cabinet.

13. The arrangement of claim 12 in which the chamber is closed off by a closure element, the closure element including a locking device for locking it in position relative to the cabinet.

14. The arrangement of claim 13 in which the closure element is the surface defining element.

15. The arrangement of claim 13 in which the closure element and a closure element surround of the cabinet have anti-jemmying features for inhibiting unauthorised access being gained to the chamber of the cabinet.

16. The arrangement of claim 12 in which the cabinet is portable, the arrangement including a mounting means for mounting the cabinet to a backing structure.

17. The arrangement of claim 16 in which the mounting means includes a securing means for lockably securing the cabinet to the backing structure.

18. The arrangement of claim 1 in which, where the key holder holds a key having a thickness approximating that of the tag, an excluder element is mounted on the ring of the key holder, the excluder element, in use, being arranged on said one side of the surface defining element.

* * * * *